US008707868B2

(12) United States Patent
Nechitailo

(10) Patent No.: US 8,707,868 B2
(45) Date of Patent: Apr. 29, 2014

(54) PRE-COMPRESSED PENETRATOR ELEMENT FOR PROJECTILE

(75) Inventor: Nicholas V. Nechitailo, Mechanicsville, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 680 days.

(21) Appl. No.: 12/291,036

(22) Filed: Jul. 7, 2009

(65) Prior Publication Data

US 2014/0026780 A1 Jan. 30, 2014

Related U.S. Application Data

(63) Continuation-in-part of application No. 11/645,262, filed on Nov. 30, 2006.

(51) Int. Cl.
*F42B 10/00* (2006.01)

(52) U.S. Cl.
USPC ..... 102/517; 102/518; 102/520

(58) Field of Classification Search
USPC ..... 102/517, 518, 520, 501, 524
See application file for complete search history.

(56) References Cited

U.S. PATENT DOCUMENTS 3,369,534 A * 2/1968 Crosman ..... 124/26
3,498,222 A * 3/1970 Birkigt ..... 102/518
3,780,658 A * 12/1973 de Longueville et al. .... 102/518
4,108,072 A 8/1978 Trinks et al. ..... 102/518
4,559,876 A * 12/1985 Bocker et al. ..... 102/520
4,635,556 A 1/1987 Boecker et al.
4,697,525 A 10/1987 Böcker et al. ..... 102/518
4,708,064 A 11/1987 Bisping ..... 102/517
4,716,834 A 1/1988 Wallow et al. ..... 102/519
4,850,278 A 7/1989 Dinkha et al. ..... 102/501
4,878,432 A 11/1989 Mikhail ..... 102/309
4,920,888 A 5/1990 Luther et al. ..... 102/518

(Continued)

OTHER PUBLICATIONS

Position Statement, Shooters Committee on Political Education, 2010. http://scopeny.org/ARCHIVES/PositionStatements/SCOPE-ArmorPiercingAmmo.pdf.

*Primary Examiner* — Michelle Clement
(74) *Attorney, Agent, or Firm* — Gerhard W. Thielman, Esquire

(57) ABSTRACT

A projectile instrument is provided for penetrating a target, the penetrator element being disposable in a projectile. The instrument includes a substantially cylindrical core, first and second plates and first and second devices. The core has first and second ends and a radially extending surface. The first plate supports the first end; the second plate supports the second end. The first device radially constrains the surface, whereas the second device axially constrains the first and second ends respectively disposed between their corresponding plates. Preferably, the core is either a ceramic or else is composed of reactive materials. In one embodiment, the first plate and the first device combine as a closed sleeve; the second plate is a lid removably secured to the first plate; and the second device is a helical spring disposed between the first end and the first plate. In another embodiment, the first and second devices constitute a plurality of bolt-and-nut assemblies, each bolt-and-nut assembly having a bolt and a nut, the bolt having a shaft terminating at head and tail ends, the shaft mechanically engaging the surface, the head end having a cap mounted to the shaft and male threads on the tail end, and the nut has female threads compatible with the male threads, the head and the bolt engaging against the first and second plates to compress the core.

4 Claims, 1 Drawing Sheet

(56) References Cited

U.S. PATENT DOCUMENTS

| | | | | | |
|---|---|---|---|---|---|
| 5,105,713 | A | | 4/1992 | Wirgau | 89/8 |
| 5,339,743 | A | * | 8/1994 | Scarlata | 102/439 |
| 5,440,994 | A | * | 8/1995 | Alexander | 102/439 |
| 5,526,752 | A | | 6/1996 | Dahl et al. | 102/517 |
| 5,794,320 | A | * | 8/1998 | Wernz et al. | 86/55 |
| 5,796,031 | A | * | 8/1998 | Sigler | 102/520 |
| 5,834,684 | A | | 11/1998 | Taylor | 102/517 |
| 5,988,071 | A | | 11/1999 | Taylor | 102/473 |
| 6,799,518 | B1 | | 10/2004 | Williams | 102/513 |
| 7,225,742 | B2 | * | 6/2007 | Radchenko | 102/438 |
| 7,255,044 | B2 | * | 8/2007 | Rastegar et al. | 102/400 |
| 7,380,503 | B2 | | 6/2008 | Williams et al. | 102/518 |
| H2230 | H | | 8/2009 | Nechitailo | 102/517 |
| 2003/0167956 | A1 | | 9/2003 | Kellner | 102/517 |
| 2006/0144281 | A1 | | 7/2006 | Williams et al. | 102/517 |

* cited by examiner

PRE-COMPRESSED PENETRATOR ELEMENT FOR PROJECTILE

CROSS REFERENCE TO RELATED APPLICATION

The invention is a Continuation-in-Part, claims priority to and incorporates by reference in its entirety U.S. patent application Ser. No. 11/645,262 filed Nov. 30, 2006 titled "Ceramic and Stacked Penetrator Against a Hardened Target" issued as Statutory Invention Registration H002230 and assigned Navy Case 96229.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to penetrator elements in a projectile for perforating a thick-wall target, and more particularly to ceramic penetrators under pre-compression to deepen a crater in the target.

A hardened target presents challenges for a projectile delivered from an aerial platform or artillery gun due to payload mass and other design restrictions. The transportable quantity of explosive charge in the warhead limits capacity to penetrate a deeply buried target protected by extensive material to absorb the kinetic energy from impact and chemical reaction of the projectile.

Further, premature initiation of energetic materials in the warhead may produce only superficial damage to the hardened target. Such penetration may be obviated by kinetic energy transfer from a projectile to the target. However, the hardened target may absorb such an impact without sufficient damage for disablement.

SUMMARY

Conventional projectile weapons yield disadvantages addressed by various exemplary embodiments of the present invention. In particular, a warhead instrument is provided for penetrating a target, the penetrator element(s) being disposable in a projectile. The instrument includes a substantially cylindrical core, first and second plates and first and second devices.

The core has first and second ends and a radially extending surface. The first plate supports the first end; the second plate supports the second end. The first device radially constrains the surface, whereas the second device axially constrains the first and second ends respectively disposed between their corresponding plates.

Preferably, the core is either a ceramic or else is composed of reactive materials. In one embodiment, the first plate and the first device combine as a closed sleeve; the second plate is a lid removably secured to the first plate; and the second device is a helical spring disposed between the first end and the first plate.

In another embodiment, the first and second devices constitute a plurality of bolt-and-nut assemblies, each bolt-and-nut assembly having a bolt and a nut, the bolt having a shaft terminating at head and tail ends, the shaft mechanically engaging the surface, the head end having a cap mounted to the shaft and male threads on the tail end, and the nut has female threads compatible with the male threads, the head and the bolt engaging against the first and second plates to compress the core.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

Figure 2:
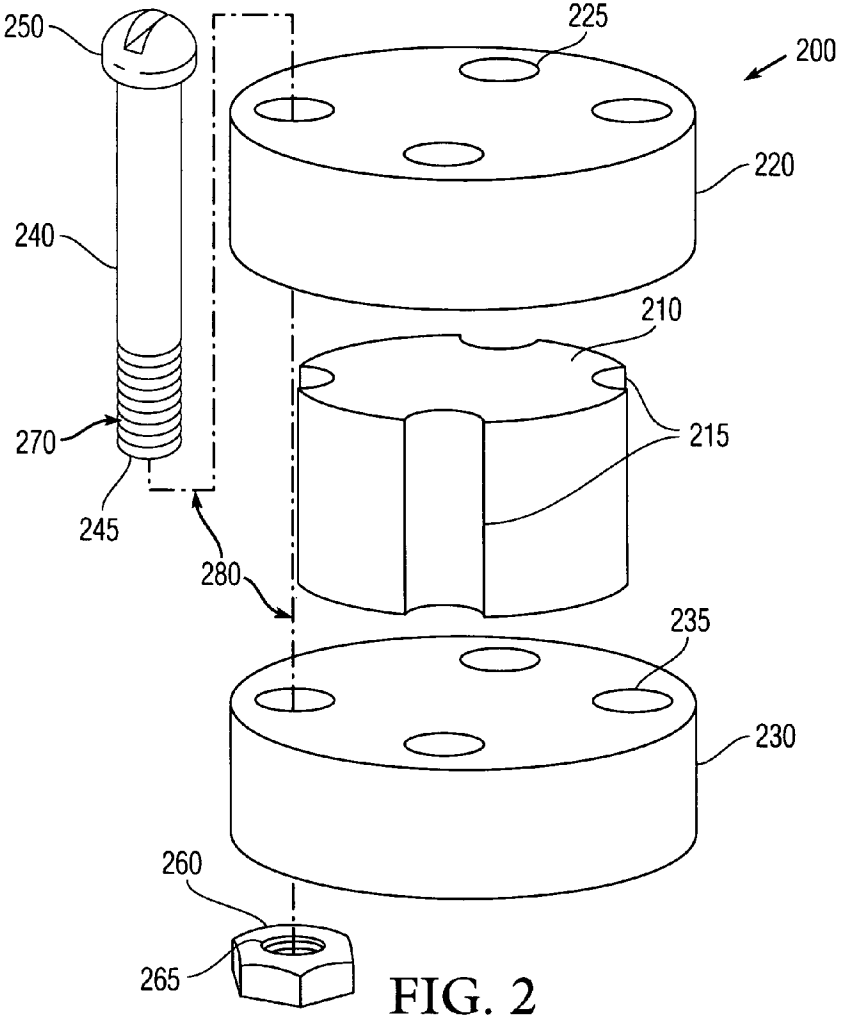
FIG. 2 is a second perspective exploded view of a related instrument.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

A target-penetrating projectile may include at least one penetrator element intended to impact (i.e., mechanically collide against) a target, thereby transferring kinetic energy thereto to cause structural damage. The projectile may include a shell to contain one or more impaction elements, as well as auxiliary or optional components, such as chemical propellants, explosive charge, guidance and control systems, etc. Under a sufficiently energetic collision the element can penetrate the target's outer casing.

A projectile as pertaining to the exemplary embodiments refers to a warhead, such as on a ballistic shell, a missile or an unpowered bomb. In particular, the element represents a ceramic penetrator. Alternatively, the projectile can contain multiple tandem ceramic penetrator elements that are segmented and sequentially arranged in columnar fashion. Such penetrator elements may be characterized as having a low aspect ratio (i.e., short and stubby).

This configuration contrasts with slender continuous-rods hinged together that remains folded in the delivery vehicle and expands on command to strike substantially parallel (i.e., tangent) to the target surface. Continuous-rods typically have limited effectiveness against a reinforced or thick-wall target due to their limited compression resistance in the axial direction.

Various ceramic and ceramic-based composites are commercially available and several super-hard nano-composites are under development. Examples of ceramic materials include diamond, tungsten carbide, silicon carbide, aluminum oxide, beryllium oxide, magnesium oxide, and zirconium oxide. In preferred embodiments, ceramic materials have high Hugoniot elastic limit (HEL), commonly used to characterize material impact strength, as well as high mass density and low cost.

At the impact speeds typically above 2-3 km/s, these ceramic materials exhibit very high impact strength and thermal stability offering superior penetration properties over high-strength metals. Also, some launching methods, such as by railgun, provide for a more gradual acceleration of projectile as compared to explosive launch. More gradual acceleration of projectiles produce lower level of tensile waves traveling in the projectile materials and thus may produce less damage to brittle ceramic-type materials.

As example, tungsten carbide (WC, $W_2C$) ceramic is a high-density material with attractive compressive and tensile strength properties. Cercom, Inc., at 991 Park Center Dr, Vista Calif. 92081, manufactured hot-pressed tungsten carbide ceramic. The density and HEL of tungsten carbide varies between 15.53 and 15.56 g/cm$^3$ and 6.6±0.5 GPa, respectively. By comparison, one of the best commonly-used penetrating metal—tungsten alloy containing tungsten (W), nickel (Ni), and iron (Fe) in the ratio of 92.85:4.9:2.25 by weight has an HEL near 2.76±0.26 GPa. This tungsten alloy deforms plastically above its HEL, and its spall strength is determined as 1.9 GPa.

Alternatively, the penetrator element may be composed of compatible reactive materials that are chemically inert at standard pressure and temperature, but exothermally react under shock. Reactive materials generally include particles or powdered forms of one or more reactive metals, one or more oxidizers, and typically some binder materials.

The reactive metals may include aluminium (Al), beryllium (Be), hafnium (Hf), lithium (Li), magnesium (Mg), thorium (Th), titanium (Ti), uranium (U) and zirconium (Zr), as well as combinations, alloys and hydrides thereof. The oxidizers may include chlorates, such as ammonium perchlorate ($NH_4ClO_4$), lithium perchlorate ($LiClO_4$), magnesium perchlorate ($Mg(ClO_4)_2$), potassium perchlorate ($KClO_4$), peroxides, and combinations thereof. The binder materials typically include epoxy resins and polymeric materials. Commonly used materials that may release pressurized gaseous products upon impact include aluminium (Al)—Teflon (Polytetrafluorethylene or PTFE), hafnium (Hf)—fluoropolymer (e.g., THV500) reactive materials as well as a number of aluminium alloys.

An unsupported ceramic or reactive penetrator element may disintegrate upon contact with the target from sudden non-isotropic compressive load, reflected from the penetrators free boundary surfaces as tensile waves. Many reactive and ceramic materials exhibit higher strength under compression but lower strength under tensile waves. Pre-compression enables better utilization of strength properties of these non-metal materials and thereby minimizes intensity of tensile wave that causes spall.

Such fragmentation is visually demonstrated in numerical deformation models shown in FIGS. 6A-6E of application Ser. No. 11/645,262. To provide appropriate mechanical support, the ceramic element, such as a cylindrical configuration is pre-compressed in the axial and radial directions. The axial direction compression represents the longitudinal forces in orientation along the axis of symmetry of the cylindrical element, intended to align perpendicular to the target surface at impact. The radial direction compression constitutes the direction of hoop stress to inhibit lateral expansion.

Figure 1:
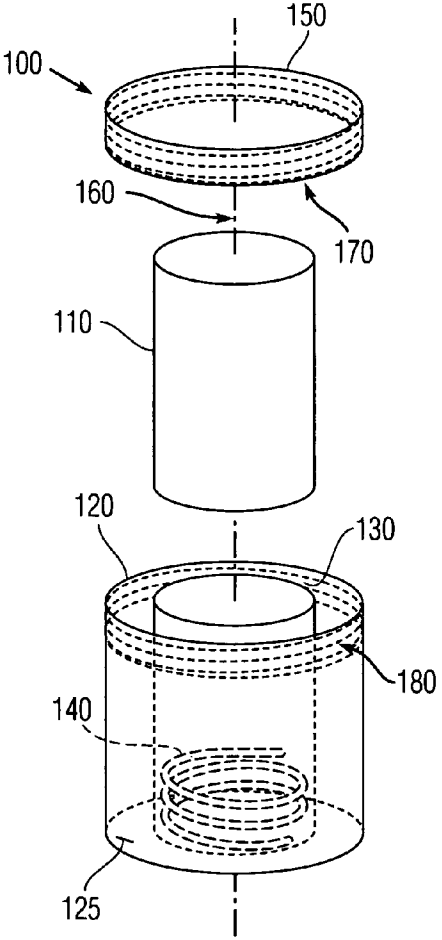
FIG. 1 is a first perspective exploded view of an instrument for penetrating a target.

FIG. 1 shows a first perspective exploded view 100 of an exemplary embodiment of a ceramic penetrator. A ceramic pellet 110, representing the penetration instrument, presents a cylindrical rod or element intended to penetrate a target upon physical contact. A metal sleeve 120, having a bottom surface 125, provides radial pre-compression. The pellet 110 can be inserted into the sleeve 120 through a cavity 130 and be supported by a helical spring 140 disposed on the surface 125. Example metals of which the sleeve 120 can be provided from include reinforced copper alloy and steel.

To provide compressive hoop stress, the pellet 110 preferably has an outer diameter slightly larger than the inner diameter of the cavity 130 to provide an interference fit. The sleeve 120, being composed of a metal, can be heated to thermally expand the cavity's inner diameter. Upon insertion of the pellet 110 into the cavity 130, the sleeve 120 is permitted to cool, thereby radially compressing the pellet 110. Subsequently, a lid 150 can be disposed over the sleeve 120 to provide longitudinal compression together with the spring 140.

The lid 160, pellet 110 and sleeve 120 can be longitudinally aligned along a common axis 160 of angular symmetry. Securing the lid 150 onto the sleeve 120 can be accomplished by clamps, or alternatively by female helical threads 170 on the lid 150 that mechanically engage counterpart male threads 180 on the sleeve 120. Combination of the sleeve 120, the spring 140 and the lid 150 constitutes a jacket for the pellet 110 to impose preload compression for that ceramic element.

FIG. 2 shows a second perspective exploded view 200 of an exemplary embodiment. A ceramic pellet 210 providing a cylindrical rod with a plurality of longitudinally parallel scarps 215 cut therefrom symmetrically disposed around the outer radius, represents the penetration instrument. The pellet 210 is sandwiched between an upper circular plate 220, having orifices 225 that correspond to the scarps 215, and a lower circular plate 230, having orifices 235 that also correspond to the scarps 215.

The plates 220, 230 are compressively loaded by a plurality of bolts 240 that pass through the orifices 225, 235 and adjacent to the scarps 215. Each bolt inserts from a tail 245 opposite a head 250 into a corresponding top orifice 225 and passes through the corresponding bottom orifice 235 to be secured by a nut 260 having an orifice 265 with female threads. At the tail 245, the bolt 240 includes male threads 270 to engage the nut 260.

Each bolt 240 progressively passes along a path 280 aligned longitudinally parallel to the axis of symmetry. The pellet 210 longitudinally compresses by tightening the nuts 260 evenly against the lower plate 230, while maintaining radial stress locally by the bolts 240 that constrain radial expansion.

Upon reaching the target, the projectile collides against the target surface releasing the jacket that contains the pellet. Upon contact, the jacket fragments, leaving the pellet to continue by momentum into the target surface. By providing compressive pre-loading along the exterior surfaces of the ceramic element (e.g., pellet), the jacket enables the element to maintain mechanical integrity during the penetration process upon striking the target.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An instrument for penetrating a target, said instrument being disposable in a projectile, said instrument comprising:

a substantially cylindrical core having first and second ends and an axisymmetric circular-cross-section surface that radially extends therebetween along a length between said ends;

a first plate for axially supporting said first end;

a second plate for axially supporting said second end;

an annular tube for radially constraining by interference fit said surface between said first and second ends along said length; and a compression device for axially engaging said first and second ends respectively disposed between said first and second plates, wherein said first and second ends and said compression device cooperate to constrain said core in axial compression.

2. The instrument according to claim 1, wherein said core is a ceramic and said annular tube is metal.

3. The instrument according to claim 1, wherein said first plate and said annular tube combine as a closed sleeve, said second plate is a lid removably secured to said annular tube, and said compression device is a helical spring disposed axially between said first end and said first plate.

4. The instrument according to claim 2, wherein said interference fit is accomplished by causing said annular sleeve to thermally expand by temporal heating, followed by inserting said core into said annular sleeve.

* * * * *

UNITED STATES PATENT AND TRADEMARK OFFICE

CERTIFICATE OF CORRECTION

PATENT NO. : 8,707,868 B2
APPLICATION NO. : 12/291036
DATED : April 29, 2014
INVENTOR(S) : Nicholas V. Nechitailo It is certified that error appears in the above-identified patent and that said Letters Patent is hereby corrected as shown below:

On the title page

Item (75) Inventor: "Mechanicsville" should be corrected to --King George--, correcting the residence.

Signed and Sealed this
Twenty-fourth Day of June, 2014

Michelle K. Lee

Michelle K. Lee
*Deputy Director of the United States Patent and Trademark Office*